US012479556B2

(12) United States Patent
Hikosaka

(10) Patent No.: US 12,479,556 B2
(45) Date of Patent: Nov. 25, 2025

(54) OUTBOARD MOTOR

(71) Applicant: SUZUKI MOTOR CORPORATION, Hamamatsu (JP)

(72) Inventor: Tomokazu Hikosaka, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 430 days.

(21) Appl. No.: 18/080,908

(22) Filed: Dec. 14, 2022

(65) Prior Publication Data

US 2023/0202636 A1 Jun. 29, 2023

(30) Foreign Application Priority Data

Dec. 23, 2021 (JP) ..... 2021-209508

(51) Int. Cl.
*B63H 20/28* (2006.01)
*B63H 20/14* (2006.01)
*B63H 20/32* (2006.01)

(52) U.S. Cl.
CPC ..... *B63H 20/285* (2013.01); *B63H 20/14* (2013.01); *B63H 20/32* (2013.01)

(58) Field of Classification Search
CPC ..... B63H 20/285; B63H 20/14; B63H 20/32
See application file for complete search history.

(56) References Cited

U.S. PATENT DOCUMENTS 8,333,629 B2 * 12/2012 McChesney ..... F02B 61/045 440/88 P
2009/0163094 A1 * 6/2009 Fukuoka ..... F01M 9/10 440/88 P
2010/0126439 A1 5/2010 Fukuoka ..... 123/41.47
2015/0367925 A1 12/2015 Oguma et al. ..... B63H 20/28
2016/0185433 A1 6/2016 Achiwa et al. ..... B63H 20/14
2021/0001969 A1 1/2021 Ikegaya et al. ..... B63H 20/20
2021/0053664 A1 * 2/2021 Nanjo ..... B63H 20/20
2021/0102489 A1 4/2021 Saruwatari et al. ..... F01P 11/06

FOREIGN PATENT DOCUMENTS

JP 2009-127499 A 6/2009
JP 2015-202852 A 11/2015
JP 2016-005927 A 1/2016
JP 2021-011179 A 2/2021
JP 2021-054373 A 4/2021

OTHER PUBLICATIONS

Notice of Reasons for Refusal dated Sep. 2, 2025, issued by the Japanese Patent Office in corresponding application JP 2021-209508.

* cited by examiner

*Primary Examiner* — Stephen P Avila
(74) *Attorney, Agent, or Firm* — Stein IP, LLC

(57) ABSTRACT

An outboard motor includes a power source, a drive shaft, a propeller shaft, a propeller attached to the propeller shaft, a case covering the power source, the drive shaft, and the propeller shaft, a water intake passage provided in the case, through which water is taken into the case from an outside of the outboard motor, a first pump configured to be driven by rotation of the drive shaft and to supply the water taken in from the water intake passage to the power source as cooling water, and a second pump configured to be driven by rotation of the drive shaft and to supply the water taken in from the water intake passage to the power source as the cooling water. The first pump and the second pump are arranged in a distributed manner in the outboard motor.

6 Claims, 7 Drawing Sheets

OUTBOARD MOTOR

CROSS-REFERENCE TO RELATED APPLICATIONS

The disclosure of Japanese Patent Application No. 2021-209508 filed on Dec. 23, 2021, including specification, drawings and claims is incorporated herein by reference in its entirety.

TECHNICAL FIELD

The present disclosure relates to an outboard motor including a cooling mechanism that cools a power source and the like.

BACKGROUND ART

An outboard motor including a cooling mechanism that takes in water such as seawater or lake water and cools a power source or the like by using the taken-in water as cooling water has been known. The cooling mechanism for the outboard motor in the related art includes a water intake port provided in a portion sinking below a water surface in a case of the outboard motor such as a lower case; a water supply passage for supplying water flowing into the outboard motor from the water intake port to a power source or the like as cooling water, a cooling passage such as a water jacket provided in the power source or the like in which the cooling water supplied through the water supply passage is circulated to cool the power source or the like, a water discharge passage for transferring the cooling water after circulating through the cooling passage to a water discharge port, the water discharge port provided in a lower rear portion of the lower case through which the cooling water transferred through the water discharge passage to the outside of the outboard motor, and a pump for sequentially circulating the water flowing into the outboard motor from the water intake port through the water supply passage, the cooling passage, and the water discharge passage and discharging the water from the water discharge port to the outside of the outboard motor. The cooling mechanism for the outboard motor in the related art includes, as the pump, a single pump that is driven by using a rotational output from the power source.

Patent Literature 1 below discloses an outboard motor including such a cooling mechanism.

Patent Literature 1: JP2009-127499A

For example, when output of the power source of the outboard motor is increased in order to strengthen a propulsive force of a boat, the amount of heat generated by the power source and the like is increased. Therefore, it is required to improve the effect of cooling the power source and the like by using the cooling mechanism of the outboard motor.

By increasing a discharge amount of the pump and increasing a flow rate of the cooling water flowing through the cooling passage such as the water jacket, the cooling effect produced by the cooling mechanism can be improved. However, in order to increase the discharge amount of the pump, it is necessary to increase a diameter dimension and a height (width) dimension of an impeller of the pump, and as a result, the volume of the pump increases. Therefore, in order to deal with the increase in the volume of the pump, it is essential to increase the volume of a case (for example, a lower case or an upper case) of the outboard motor that accommodates the pump. Accordingly, the outboard motor increases in size. An increase in size of the outboard motor has disadvantages such as causing an increase in resistance of water during navigation.

The present disclosure has been made in view of, for example, the above-described problems, and an object of the present disclosure is to provide an outboard motor capable of improving an effect of cooling a power source and the like while preventing an increase in size of the outboard motor.

SUMMARY

In order to solve the above problem, there is provided an outboard motor for propelling a boat, the outboard motor including: a power source provided at an upper portion of the outboard motor; a drive shaft extending in an up-down direction from the power source toward a lower portion of the outboard motor and configured to be rotated by a rotational output of the power source; a propeller shaft provided at the lower portion of the outboard motor and configured to be rotated by rotation of the drive shaft; a propeller attached to the propeller shaft; a case covering the power source, the drive shaft, and the propeller shaft; a water intake passage provided in the case, through which water is taken into the case from an outside of the outboard motor; a first pump configured to be driven by rotation of the drive shaft and to supply the water taken in from the water intake passage to the power source as cooling water; and a second pump configured to be driven by rotation of the drive shaft and to supply the water taken in from the water intake passage to the power source as the cooling water. The first pump and the second pump are arranged in a distributed manner in the outboard motor.

DESCRIPTION OF EMBODIMENTS

An outboard motor according to an embodiment of the present disclosure includes: a power source that is provided at an upper portion of the outboard motor; a drive shaft that extends in an up-down direction from the power source toward a lower portion of the outboard motor and is rotated by a rotational output of the power source; a propeller shaft that is provided at the lower portion of the outboard motor and is rotated by rotation of the drive shaft; a propeller that is attached to the propeller shaft; a case that covers the power source, the drive shaft, and the propeller shaft; a water intake passage that is provided in the case and through which water is taken into the case from an outside of the outboard motor; a first pump that is driven by rotation of the drive shaft and supplies water taken in from the water intake passage to the power source as cooling water; and a second pump that is driven by rotation of the drive shaft and supplies water taken in from the water intake passage to the power source as cooling water. The first pump and the second pump are arranged in a distributed manner in the outboard motor.

According to the outboard motor of the present embodiment, since the first pump and the second pump are provided, even when each of the first pump and the second pump is a small pump, the amount of cooling water to be supplied to the power source can be increased by simultaneously driving these two pumps to supply the cooling water to the power source (for example, a cooling passage such as a water jacket provided at the power source), and the effect of cooling the power source can be improved. In addition, according to the method of arranging the two small pumps in a distributed manner, the two pumps can be provided in the outboard motor by using small empty areas or the like existing in a distributed manner in the outboard motor, and an increase in size of the outboard motor can be prevented.

Embodiment

An outboard motor according to an embodiment of the present disclosure will be described. In the embodiment, the directions of up (Ud), down (Dd), front (Fd), rear (Bd), left (Ld), and right (Rd) are indicated by arrows drawn at the lower right of FIGS. 1 to 8.

Outboard Motor

Figure 1:
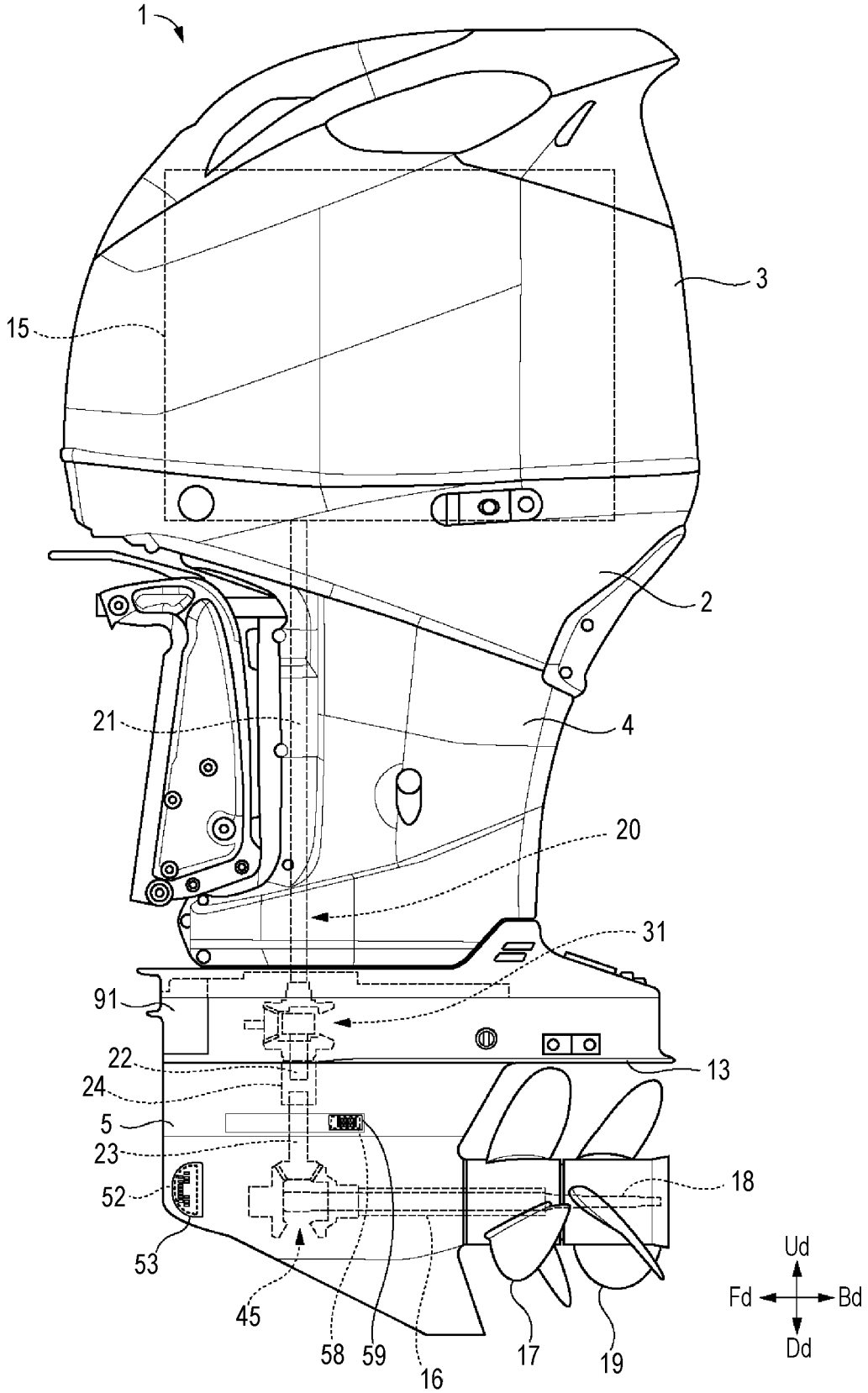
FIG. 1 is a general view illustrating an outboard motor according to an embodiment of the present disclosure.
Figure 2:
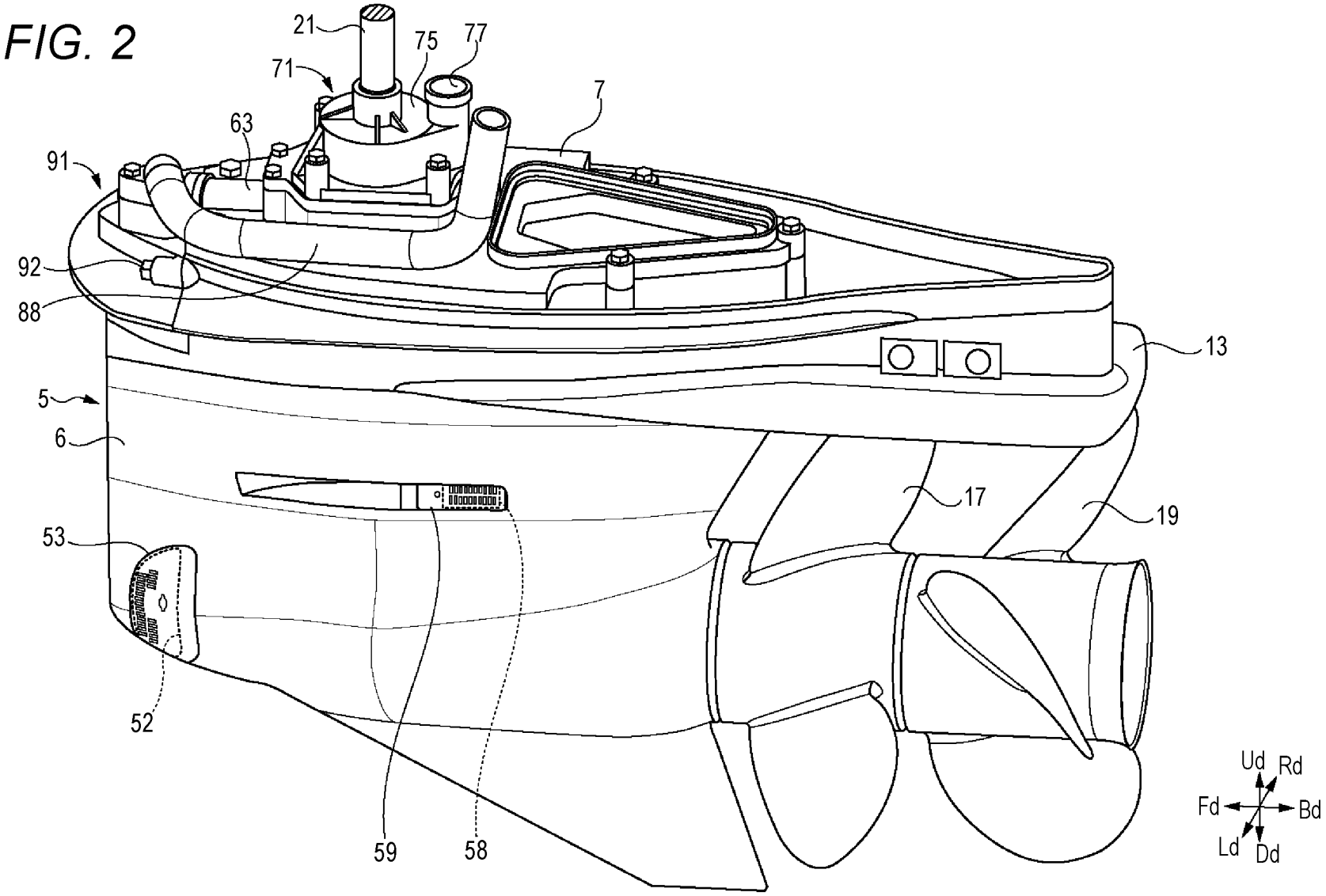
FIG. 2 is a perspective view illustrating a lower portion of the outboard motor shown in FIG. 1.
Figure 3:
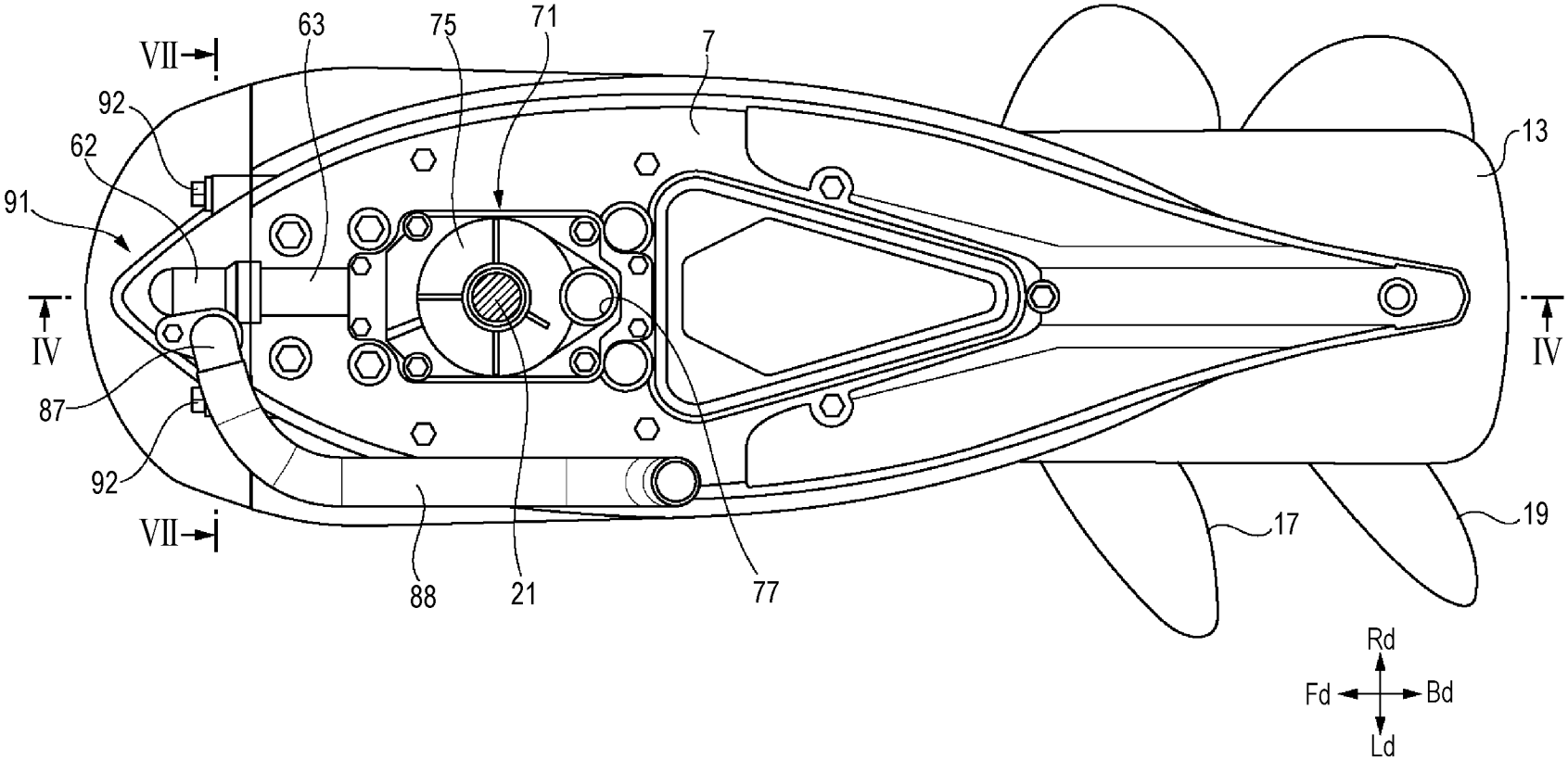
FIG. 3 is a plan view illustrating the lower portion of the outboard motor shown in FIG. 2.
Figure 4:
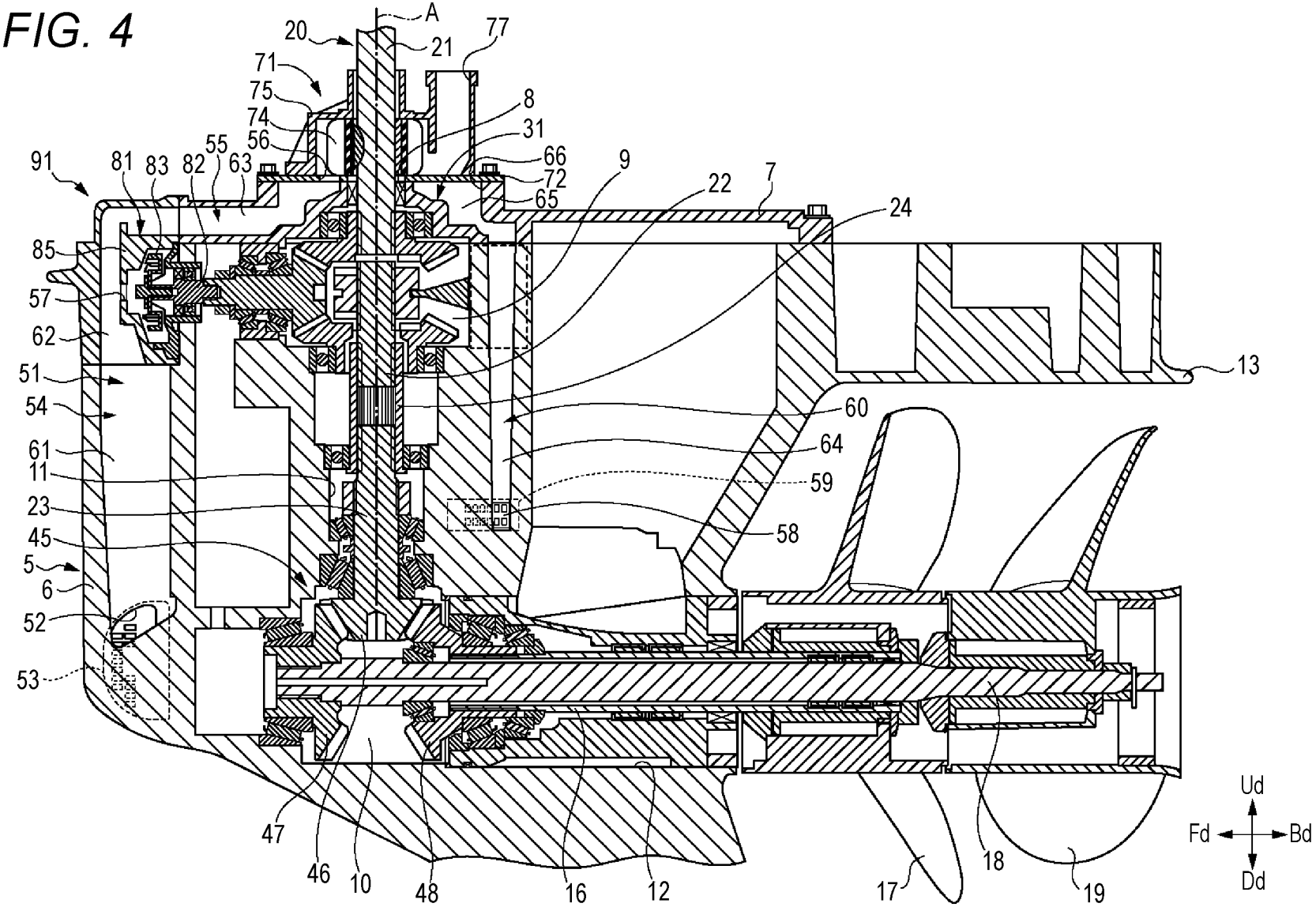
FIG. 4 is a cross-sectional view illustrating the lower portion of the outboard motor taken along a cutting line IV-IV in FIG. 3.

FIG. 1 illustrates an outboard motor 1 according to an embodiment of the present disclosure. FIG. 2 illustrates a lower portion of the outboard motor 1 as viewed from a left rear upper side. FIG. 3 illustrates the lower portion of the outboard motor 1 as viewed from an upper side. FIG. 4 illustrates a cross section of the lower portion of the outboard motor 1 taken along a cutting line IV-IV in FIG. 3, as viewed from a left side (at a lower side in FIG. 3).

The outboard motor 1 is a device for propelling a boat. As illustrated in FIG. 1, the outboard motor 1 of the present embodiment is a counter-rotating propeller type outboard motor. The outboard motor 1 includes an engine 15 serving as a power source, an outer propeller shaft 16, a front propeller 17 attached to the outer propeller shaft 16, an inner propeller shaft 18 provided inside the outer propeller shaft 16, a rear propeller 19 attached to the inner propeller shaft 18, a drive shaft 20 rotated by a rotational output of the engine 15, a gear mechanism 45 that transmits rotation of the drive shaft 20 to the propeller shafts 16 and 18, and a rotation direction switching mechanism 31 that switches a rotation direction of the propeller shafts 16 and 18.

The engine 15 is disposed at an upper portion of the outboard motor 1, and the propeller shafts 16 and 18 are disposed at the lower portion of the outboard motor 1. The drive shaft 20 extends in an up-down direction from the engine 15 toward the lower portion of the outboard motor 1. The drive shaft 20 is divided into an upper shaft portion 21, an intermediate shaft portion 22, and a lower shaft portion 23. An upper end portion of the upper shaft portion 21 is connected to the engine 15. The intermediate shaft portion 22 and the lower shaft portion 23 are coupled to each other by a coupling member 24. The rotation direction switching mechanism 31 is provided between the upper shaft portion 21 and the intermediate shaft portion 22, and switches the rotation direction of each of the propeller shafts 16 and 18 by switching a rotation direction of the intermediate shaft portion 22 with respect to the upper shaft portion 21. The gear mechanism 45 is disposed at the lower portion of the outboard motor 1 and connects a lower end portion of the lower shaft portion 23 and front end portions of the propeller shafts 16 and 18.

The engine 15 is covered with a bottom cowl 2 and a top cowl 3. The upper shaft portion 21 is covered with an upper case 4. The rotation direction switching mechanism 31, the intermediate shaft portion 22, the coupling member 24, the lower shaft portion 23, the gear mechanism 45, and front portions of the propeller shafts 16 and 18 are covered with a lower case 5.

As illustrated in FIGS. 2 to 4, the lower case 5 includes a lower case body 6 that is formed in a substantially box shape with an open upper portion, and a lid member 7 that covers the upper portion of the lower case body 6. As illustrated in FIG. 4, a drive shaft insertion hole 8 is formed in the lid member 7. An upper accommodating chamber 9 is provided in a front upper portion of the lower case 5. The drive shaft insertion hole 8 communicates with the upper accommodating chamber 9. A lower accommodating chamber 10 is provided in a front lower portion of the lower case 5. A connection hole 11 is formed between the upper accommodating chamber 9 and the lower accommodating chamber 10 in the lower case 5 to connect the upper accommodating chamber 9 and the lower accommodating chamber 10. In the lower case 5, a propeller shaft arrangement hole 12 is formed at a rear side of the lower accommodating chamber 10. Further, as illustrated in FIG. 2, an anti-cavitation plate 13 is provided at a rear upper portion of the lower case body 6 to prevent air from being drawn toward the propellers 17 and 19.

The outer propeller shaft 16 and the inner propeller shaft 18 are specific examples of a "propeller shaft", and the front propeller 17 and the rear propeller 19 are specific examples of a "propeller". The upper shaft portion 21 is a specific example of a "first shaft portion", and the intermediate shaft portion 22, the lower shaft portion 23, and the coupling member 24 are specific examples of a "second shaft portion". The bottom cowl 2, the top cowl 3, the upper case 4, and the lower case 5 are specific examples of a "case", and the bottom cowl 2 and the top cowl 3 are also specific examples of a "cowl".

Mechanism Involved in Propulsive Force Generation

Figure 5:
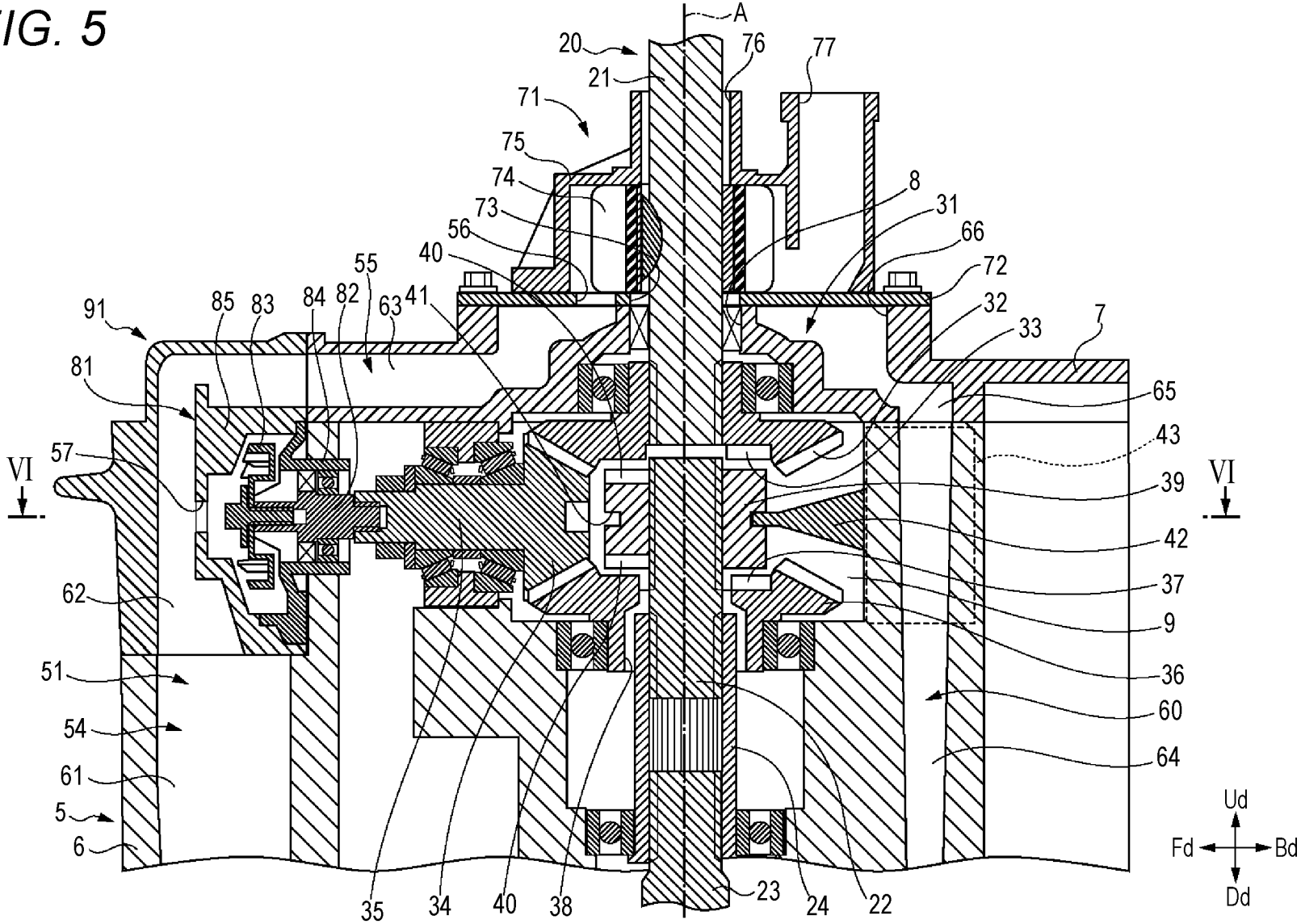
FIG. 5 is a cross-sectional view illustrating mechanisms disposed in and around an upper accommodating chamber in the lower portion of the outboard motor shown in FIG. 4.
Figure 6:
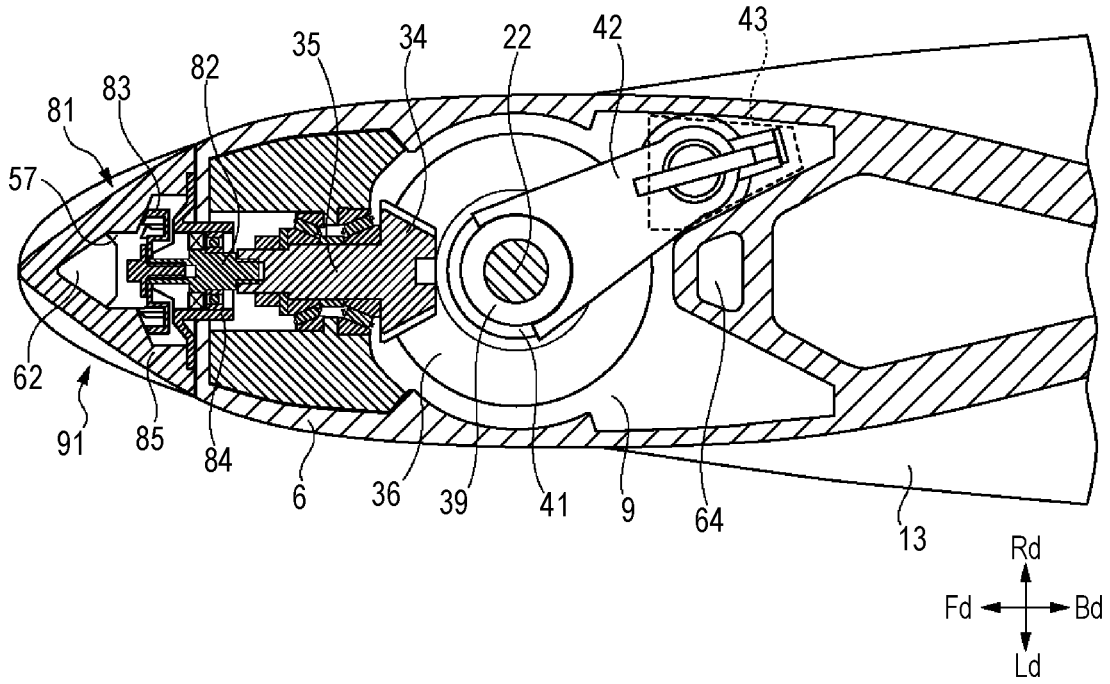
FIG. 6 is a cross-sectional view illustrating the lower portion of the outboard motor taken along a cutting line VI-VI in FIG. 5.

FIG. 5 is an enlarged view illustrating mechanisms disposed in and around the upper accommodating chamber 9 of the lower case 5 in FIG. 4. FIG. 6 illustrates a cross section of the lower portion of the outboard motor 1 taken along a cutting line VI-VI in FIG. 5, as viewed from the upper side.

An upper end side of the upper shaft portion 21 of the drive shaft 20 is connected to the engine 15, and a lower end side thereof is inserted into the drive shaft insertion hole 8 and connected to the rotation direction switching mechanism 31, as illustrated in FIG. 5. The upper shaft portion 21 is rotated in one direction by the rotational output of the engine 15. Hereinafter, the rotation direction of the upper shaft portion 21 is referred to as a forward direction.

The rotation direction switching mechanism 31 is disposed in the upper accommodating chamber 9 of the lower case 5. The rotation direction switching mechanism 31 includes a reverse drive gear 32, a reverse intermediate gear 34, an intermediate gear shaft 35, a reverse output gear 36, and a clutch 39.

The reverse drive gear 32 is a bevel gear, is disposed in an upper portion of the upper accommodating chamber 9 such that a portion where teeth are formed faces downward, and is rotatably supported by the lid member 7 via a bearing. The reverse drive gear 32 is, for example, spline-coupled (fitted) to a lower end portion of the upper shaft portion 21, and rotates in the forward direction integrally with the upper shaft portion 21.

The reverse intermediate gear 34 is a bevel gear and is disposed at a front portion of the upper accommodating chamber 9 such that a portion where teeth are formed faces rearward. The intermediate gear shaft 35 is a shaft that supports the reverse intermediate gear 34 in the lower case body 6, and is disposed at a front portion of the upper accommodating chamber 9. The reverse intermediate gear 34 and the intermediate gear shaft 35 are disposed at a front side of the drive shaft 20 the intermediate shaft portion 22) in the lower case 5. The intermediate gear shaft 35 extends in a front-rear direction and has an axis perpendicular to an axis A of the drive shaft 20. The reverse intermediate gear 34 is coupled and fixed to a rear end portion of the intermediate gear shaft 35. In the present embodiment, the intermediate gear shaft 35 and the reverse intermediate gear 34 are formed integrally with each other. The intermediate gear shaft 35 is rotatably supported by the lower case body 6 via a bearing. The intermediate gear shaft 35 and the reverse intermediate gear 34 rotate integrally.

The reverse output gear 36 is a bevel gear, is disposed in a lower portion of the upper accommodating chamber 9 such that a portion where teeth are formed faces upward, and is rotatably supported by the lower case body 6 via a bearing. The reverse output gear 36 is disposed coaxially with the reverse drive gear 32. A through hole 38 is formed in a central portion of the reverse output gear 36. An upper-end-side portion of the intermediate shaft portion 22 is inserted into the through hole 38, but the through hole 38 and the upper-end-side portion of the intermediate shaft portion 22 are separated from each other.

The reverse drive gear 32 meshes with the reverse intermediate gear 34, and the reverse intermediate gear 34 meshes with the reverse output gear 36. When the reverse drive gear 32 rotates in the forward direction, the rotation is transmitted to the reverse output gear 36 via the reverse intermediate gear 34 and the reverse output gear 36 rotates in a reverse direction.

The clutch 39 is a member having a function of selecting whether to transmit the rotation of the upper shaft portion 21 or the reverse drive gear 32 in the forward direction to the intermediate shaft portion 22 or to transmit the rotation of the reverse output gear 36 in the reverse direction to the intermediate shaft portion 22. The clutch 39 is a dog clutch and is formed in a cylindrical shape, and clutch pawls 40 are formed on an upper end surface and a lower end surface thereof, respectively. A groove 41 is formed over the entire circumference of an outer peripheral surface of the clutch 39. The clutch 39 is disposed between the reverse drive gear 32 and the reverse output gear 36.

The upper-end-side portion of the intermediate shaft portion 22 passes through the through hole 38 of the reverse output gear 36 and enters between the reverse drive gear 32 and the reverse output gear 36. The clutch 39 is coupled to the upper-end-side portion of the intermediate shaft portion 22 so as to be immovable in a circumferential direction but movable in an axial direction with respect to the intermediate shaft portion 22. Accordingly, the clutch 39 and the intermediate shaft portion 22 rotate integrally, and the clutch 39 can move in the up-down direction with respect to the intermediate shaft portion 22.

In the lower case 5, a shift fork 42 is provided at a rear portion of the upper accommodating chamber 9, and a clutch control portion 43 is provided at a rear side of the upper accommodating chamber 9. The shift fork 42 and the clutch control portion 43 are disposed at a rear side of the drive shaft 20 (intermediate shaft portion 22) in the lower case 5. As illustrated in FIG. 6, the clutch control portion 43 is disposed on one side (for example, a right side) in a left-right direction in the lower case 5. The shift fork 42 extends in the front-rear direction while being inclined in the left-right direction. A front end portion of the shift fork 42 is formed in a fork shape, and is inserted into the groove 41 of the clutch 39 such that the clutch 39 is rotatable with respect to the shift fork 42. A rear end portion of the shift fork 42 is connected to an actuator (not illustrated) provided at the clutch control portion 43.

By operating the actuator of the clutch control portion 43, the shift fork 42 can be moved in the up-down direction, and the clutch 39 can be moved in the up-down direction. When the clutch 39 moves upward, the clutch pawl 40 formed on the upper end surface of the clutch 39 engages with a clutch pawl 33 formed on a lower end surface of the reverse drive gear 32. Accordingly, the rotation of the reverse drive gear 32 in the forward direction is directly transmitted to the intermediate shaft portion 22, and as a result, the intermediate shaft portion 22 rotates in the forward direction. On the other hand, when the clutch 39 moves downward, the clutch pawl 40 formed on the lower end surface of the clutch 39 engages with a clutch pawl 37 formed on an upper end surface of the reverse output gear 36. Accordingly, the rotation of the reverse output gear 36 in the reverse direction is transmitted to the intermediate shaft portion 22, and as a result, the intermediate shaft portion 22 rotates in the reverse direction. When the clutch 39 is located at a neutral position, the clutch pawl 40 formed on the upper end surface of the clutch 39 is not engaged with the clutch pawl 33 of the reverse drive gear 32, and the clutch pawl 40 formed on the lower end surface of the clutch 39 is not engaged with the clutch pawl 37 of the reverse output gear 36, neither the rotation of the reverse drive gear 32 nor the rotation of the reverse output gear 36 is transmitted to the intermediate shaft portion 22. In this case, the intermediate shaft portion 22 does not rotate.

As illustrated in FIG. 4, the intermediate shaft portion 22 and the lower shaft portion 23 extend in the up-down direction in the connection hole 11. The intermediate shaft portion 22 is located below the upper shaft portion 21 and is arranged coaxially with the upper shaft portion 21. The upper-end-side portion of the intermediate shaft portion 22 is coupled to the clutch 39 as described above. The lower end portion of the intermediate shaft portion 22 is connected to the lower shaft portion 23 via the coupling member 24. The lower shaft portion 23 is located below the intermediate shaft portion 22 and is arranged coaxially with the intermediate shaft portion 22. The coupling member 24 is formed in a tubular shape, the lower end portion of the intermediate shaft portion 22 is inserted into an upper portion of the coupling member 24, and an upper end portion of the lower shaft portion 23 is inserted into a lower portion of the coupling member 24. Splines are formed on an inner peripheral surface of the coupling member 24, an outer peripheral surface of the lower end portion of the intermediate shaft portion 22, and an outer peripheral surface of the upper end portion of the lower shaft portion 23, and the lower end portion of the intermediate shaft portion 22 and the upper end portion of the lower shaft portion 23 are spline-coupled to the coupling member 24. The coupling member 24 is rotatably supported by the lower case body 6 via a bearing. The lower shaft portion 23 is rotatably supported by the connection hole 11 via a bearing. The intermediate shaft portion 22, the lower shaft portion 23, and the coupling member 24 rotate integrally.

The gear mechanism 45 is a mechanism that transmits the rotation of the lower shaft portion 23 to the propeller shafts 16 and 18. The gear mechanism 45 is disposed in the lower accommodating chamber 10. The gear mechanism 45 includes a main drive gear 46, a front driven gear 47, and a rear driven gear 48.

The main drive gear 46 is a bevel gear, and is disposed at an upper portion of the lower accommodating chamber 10 such that a portion where teeth are formed faces downward. The main drive gear 46 is coupled to and fixed to the lower end portion of the lower shaft portion 23. In the present embodiment, the main drive gear 46 and the lower shaft portion 23 are integrally formed with each other. The main drive gear 46 rotates integrally with the lower shaft portion 23.

The front driven gear 47 is a bevel gear and is disposed at a front portion of the lower accommodating chamber 10 such that a portion where teeth are formed faces rearward. The front driven gear 47 is rotatably supported by the lower case body 6 via a bearing. The front driven gear 47 is disposed at a front side of the main drive gear 46 and meshes with the main drive gear 46.

The rear driven gear 48 is a bevel gear and is disposed at a rear portion of the lower accommodating chamber 10 such that a portion where teeth are formed faces forward. The rear driven gear 48 is rotatably supported by the lower case body 6 via a bearing. The rear driven gear 48 is disposed at a rear side of the main drive gear 46 and meshes with the main drive gear 46.

As illustrated in FIG. 4, the outer propeller shaft 16 is formed in a tubular shape and extends in the front-rear direction. A front-end-side portion of the outer propeller shaft 16 is disposed in the propeller shaft arrangement hole 12, and the outer propeller shaft 16 is rotatably supported by the lower case body 6 via a bearing. The rear driven gear 48 is spline-coupled to a front end portion of the outer propeller shaft 16. Accordingly, the rear driven gear 48 and the outer propeller shaft 16 rotate integrally. The front propeller 17 is attached to a rear end portion of the outer propeller shaft 16.

The inner propeller shaft 18 extends in the front-rear direction, and a front portion of the inner propeller shaft 18 is disposed in the outer propeller shaft 16. The inner propeller shaft 18 is disposed coaxially with the outer propeller shaft 16. The inner propeller shaft 18 is supported by the outer propeller shaft 16 and the rear driven gear 48 via bearings so as to be rotatable with respect to the outer propeller shaft 16 and the rear driven gear 48. The front driven gear 47 is spline-coupled to a front end portion of the inner propeller shaft 18. Accordingly, the front driven gear 47 and the inner propeller shaft 18 rotate integrally. The rear propeller 19 is attached to a rear end portion of the inner propeller shaft 18.

When the main drive gear 46 rotates integrally with the lower shaft portion 23, the rotation is transmitted to the rear driven gear 48 and the front driven gear 47. As a result, the outer propeller shaft 16 and the inner propeller shaft 18 rotate. At this time, rotation directions of the outer propeller shaft 16 and the inner propeller shaft 18 are opposite to each other. As the outer propeller shaft 16 and the inner propeller shaft 18 rotate, the front propeller 17 and the rear propeller 19 rotate, respectively.

When the rotation of the upper shaft portion 21 in the forward direction is transmitted to the outer propeller shaft 16 and the inner propeller shaft 18 via the intermediate shaft portion 22, the lower shaft portion 23, the gear mechanism 45, and the like by using the clutch 39, a propulsive force for moving the boat forward is generated by the front propeller 17 and the rear propeller 19. When the rotation of the reverse output gear 36 in the reverse direction is transmitted to the outer propeller shaft 16 and the inner propeller shaft 18 via the intermediate shaft portion 22, the lower shaft portion 23, the gear mechanism 45, and the like by using the clutch 39, a propulsive force for moving the boat backward is generated by the front propeller 17 and the rear propeller 19.

Mechanism Involved in Cooling Engine and the Like

As illustrated in FIG. 4, the outboard motor 1 includes a water intake passage 51 through which water such as seawater or lake water is taken into the outboard motor 1 from the outside of the outboard motor 1, and two pumps (a primary pump 71 and a secondary pump 81) that supply the water taken in from the water intake passage 51 to the engine 15 and the like as cooling water.

The water intake passage 51 includes two main water intake ports 52, a common passage 54, a first dedicated passage 55, a first water suction port 56, a second water suction port 57, two sub-water intake ports 58, and a second dedicated passage 60.

The two main water intake ports 52 are holes through which water flows into the lower case 5 from the outside of the outboard motor 1. Each main water intake port 52 passes through a part of a wall portion of the lower case body 6. Each main water intake port 52 is located below a water surface. The two main water intake ports 52 are provided in a lower portion of a front end portion of the lower case body 6. Specifically, one main water intake port 52 is open to the left of the lower case body 6, and the other main water intake port 52 is open to the right of the lower case body 6. In order to prevent sand, dust, and the like from entering the lower case 5 through the main water intake ports 52, a cover 53 having a large number of small holes is attached to each main water intake port 52, as illustrated in FIG. 2. Each main water intake port 52 is a specific example of a "water intake port".

The common passage 54 is a passage through which the water flowing in from each main water intake port 52 is transferred toward the primary pump 71 and the secondary pump 81. Both the water transferred to the primary pump 71 and the water transferred to the secondary pump 81 flow through the common passage 54. The common passage 54 is formed by a passage portion 61 provided at the front end portion in the lower case body 6 and by a lower portion of a passage portion 62 provided at a secondary pump unit 91, which will be described later and is attached to an upper portion of a front end portion of the lower case 5. The common passage 54 extends in the up-down direction, and a lower end portion of the common passage 54 is connected to the main water intake ports 52.

The first dedicated passage 55 is a passage through which the water transferred through the common passage 54 is transferred to the primary pump 71. The first dedicated passage 55 is formed by an upper portion of the passage portion 62 provided at the secondary pump unit 91 and by a passage portion 63 provided at a front portion in the lid member 7. One end of the first dedicated passage 55 is connected to an upper portion of the common passage 54.

The first water suction port 56 is a hole through which the water transferred through the first dedicated passage 55 flows into a pump case 75 of the primary pump 71. The first water suction port 56 is provided in a bottom plate 72 of the primary pump 71. The other end of the first dedicated passage 55 is connected to the first water suction port 56.

The second water suction port 57 is a hole through which the water transferred through the common passage 54 flows into a pump case 85 of the secondary pump 81. The second water suction port 57 is provided in the secondary pump unit 91 attached to the upper portion of the front end portion of the lower case 5, and is provided between the passage portion 62 and the pump case 85 in the secondary pump unit 91. The second water suction port 57 allows the passage portion 62 to communicate with the pump case 85. Accordingly, the upper portion of the common passage 54 is connected to the inside of the pump case 85 via the second water suction port 57.

In this way, at the upper portion of the front end portion of the lower case 5, the common passage 54 branches into a passage (the first dedicated passage 55 and the first water suction port 56) connected to the primary pump 71 and a passage (the second water suction port 57) connected to the secondary pump 81. The common passage 54 is a specific example of a "main passage", and the first dedicated passage 55, the first water suction port 56, and the second water suction port 57 are specific examples of a "branch passage".

The two sub-water intake ports 58 are ports through which water flows into the lower case 5 from the outside of the outboard motor 1. Each of the sub-water intake ports 58 is a hole passing through a part of the wall portion of the lower case body 6, and is located below the water surface. One sub-water intake port 58 is provided in a left portion of the lower case body 6, and the other sub-water intake port 58 is provided in a right portion of the lower case body 6. Similarly to the main water intake port 52, a cover 59 having a large number of small holes is attached to each of the sub-water intake ports 58.

The second dedicated passage 60 is a passage through which the water flowing in from each sub-water intake port 58 is transferred toward the primary pump 71. The second dedicated passage 60 is formed by a passage portion 64 provided in an intermediate portion of the lower case body 6 in the front-rear direction and by a passage portion 65 provided in an intermediate portion of the lid member 7 in the front-rear direction. A lower end portion of the second dedicated passage 60 is connected to each of the sub-water intake ports 58, and an upper end side of the second dedicated passage 60 is connected to the first water suction port 56.

The primary pump 71 is, for example, a positive displacement pump such as a vane pump. The primary pump 71 is driven by the rotation of the drive shaft 20, specifically, the rotation of the upper shaft portion 21 of the drive shaft 20. As illustrated in FIG. 5, the primary pump 71 is mounted on an upper surface of the lower case 5. The primary pump 71 is disposed at a position intersecting the axis A of the drive shaft 20, and is provided at an outer peripheral side of the upper shaft portion 21 so as to surround the upper shaft portion 21. When the lower case 5 is attached to the upper case 4, the primary pump 71 is covered by the upper case 4. The primary pump 71 is a specific example of a "first pump".

The primary pump 71 includes the bottom plate 72, an impeller 74, and the pump case 75. The bottom plate 72 is attached to a peripheral edge portion of an opening 66 formed in the lid member 7 of the lower case 5 at a position where the axis A of the drive shaft 20 passes, so as to close the opening 66. The bottom plate 72 is provided with a drive shaft insertion hole 73. The upper shaft portion 21 is inserted into the drive shaft insertion hole 73. Since a diameter of the drive shaft insertion hole 73 is larger than a diameter of the upper shaft portion 21, the upper shaft portion 21 can rotate with respect to the drive shaft insertion hole 73. In addition, in the bottom plate 72, the first water suction port 56 is provided at a part of a portion on an outer peripheral side of the drive shaft insertion hole 73.

The impeller 74 has an axis that is coaxial with the axis A of the drive shaft 20. A boss of the impeller 74 is coupled and fixed to the upper shaft portion 21. Therefore, the impeller 74 rotates integrally with the upper shaft portion 21.

The pump case 75 is formed in a substantially tubular shape having an axis substantially coaxial with the axis A of the drive shaft 20, and covers the impeller 74. The pump case 75 is fixed on the bottom plate 72. The impeller 74 is disposed in a space defined by the pump case 75 and the bottom plate 72. A drive shaft insertion hole 76 is provided in the pump case 75, and the upper shaft portion 21 is inserted into the drive shaft insertion hole 76. Since a diameter of the drive shaft insertion hole 76 is larger than the diameter of the upper shaft portion 21, the upper shaft portion 21 can rotate with respect to the drive shaft insertion hole 76. A gap between the drive shaft insertion hole 76 and the upper shaft portion 21 is sealed. The pump case 75 is provided with a discharge port 77 for discharging, as cooling water, the water sucked from the first water suction port 56.

The secondary pump 81 is, for example, a non-positive displacement pump such as a spiral pump or a turbine pump. The secondary pump 81 is driven by the rotation of the drive shaft 20, specifically, by rotation of the intermediate gear shaft 35 that rotates when the rotation of the drive shaft 20 is transmitted via the reverse drive gear 32 and the reverse intermediate gear 34. The secondary pump 81 is disposed at a position at a front side of the drive shaft 20 and spaced apart from the drive shaft 20. Specifically, the secondary pump 81 is disposed at the front upper portion of the lower case 5. In this way, the primary pump 71 and the secondary pump 81 are arranged in a distributed manner in the outboard motor 1. As illustrated in FIG. 4, the secondary pump 81 is disposed at a position that is located below the water surface when the boat is stopped, and that is higher than the anti-cavitation plate 13. The secondary pump 81 is a specific example of a "second pump".

As illustrated in FIG. 5, the secondary pump 81 includes a pump shaft 82, an impeller 83, a shaft support portion 84, and the pump case 85. The pump shaft 82 extends in the front-rear direction and is disposed coaxially with the intermediate gear shaft 35. A rear end portion of the pump shaft 82 is, for example, spline-coupled to a front end portion of the intermediate gear shaft 35, and the pump shaft 82 rotates integrally with the intermediate gear shaft 35.

The impeller 83 has an axis that is coaxial with an axis of the intermediate gear shaft 35. A boss of the impeller 83 is coupled and fixed to a front end portion of the pump shaft 82. The impeller 83 rotates integrally with the pump shaft 82.

The shaft support portion 84 is formed in a tubular shape having an axis coaxial with the axis of the intermediate gear shaft 35. The pump shaft 82 is rotatably supported in the shaft support portion 84 via a bearing. A gap between the shaft support portion 84 and the pump shaft 82 is sealed.

Figure 7:
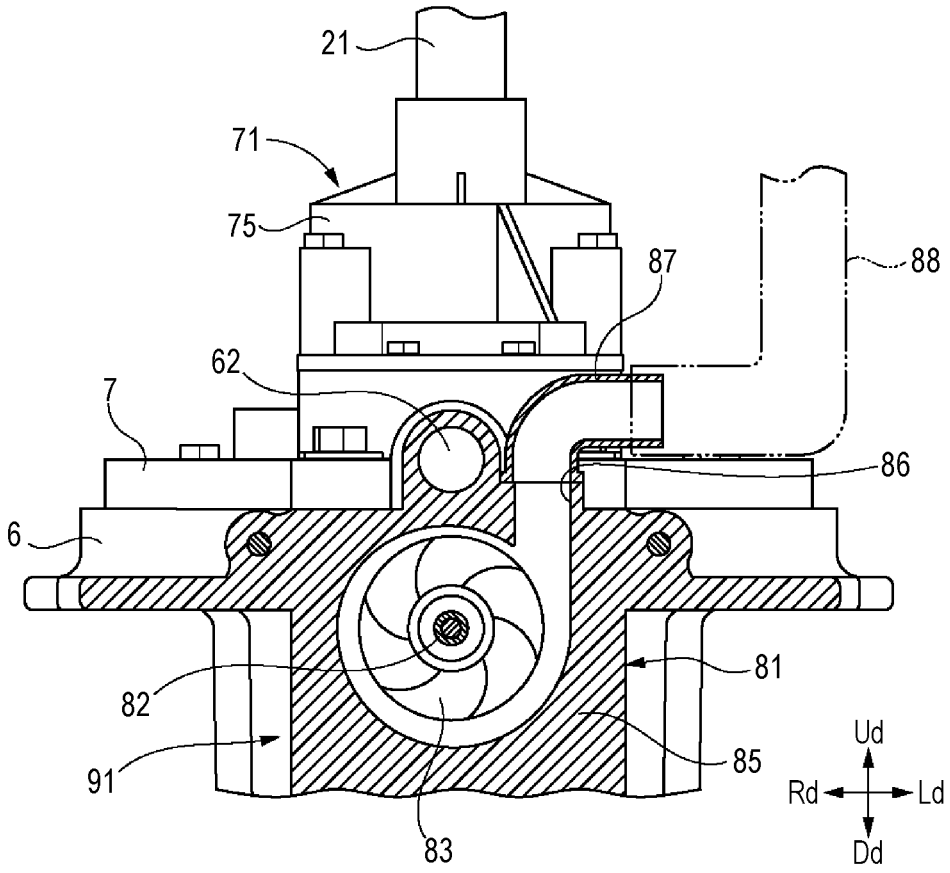
FIG. 7 is a cross-sectional view illustrating the lower portion of the outboard motor taken along a cutting line VII-VII in FIG. 3.

The pump case 85 is formed in a substantially tubular shape with a lid and having an axis substantially coaxial with the axis of the intermediate gear shaft 35, and covers the impeller 83. The pump case 85 is disposed at a front side of the shaft support portion 84 and is fixed to the shaft support portion 84. The impeller 83 is disposed in a space defined by the pump case 85 and the shaft support portion 84. The second water suction port 57 is provided in a front portion of the pump case 85. FIG. 7 illustrates a cross section of the lower portion of the outboard motor 1 taken along a cutting line in FIG. 3, as viewed from the front side (from the left of FIG. 3). As illustrated in FIG. 7, the pump case 85 is provided with a discharge port 86 through which the water sucked from the second water suction port 57 is discharged as cooling water. A connecting pipe 88 is connected to the discharge port 86 via an L-shaped joint 87. As illustrated in FIG. 3, the connecting pipe 88 extends toward a rear side at an upper side of the lower case 5.

Figure 8:
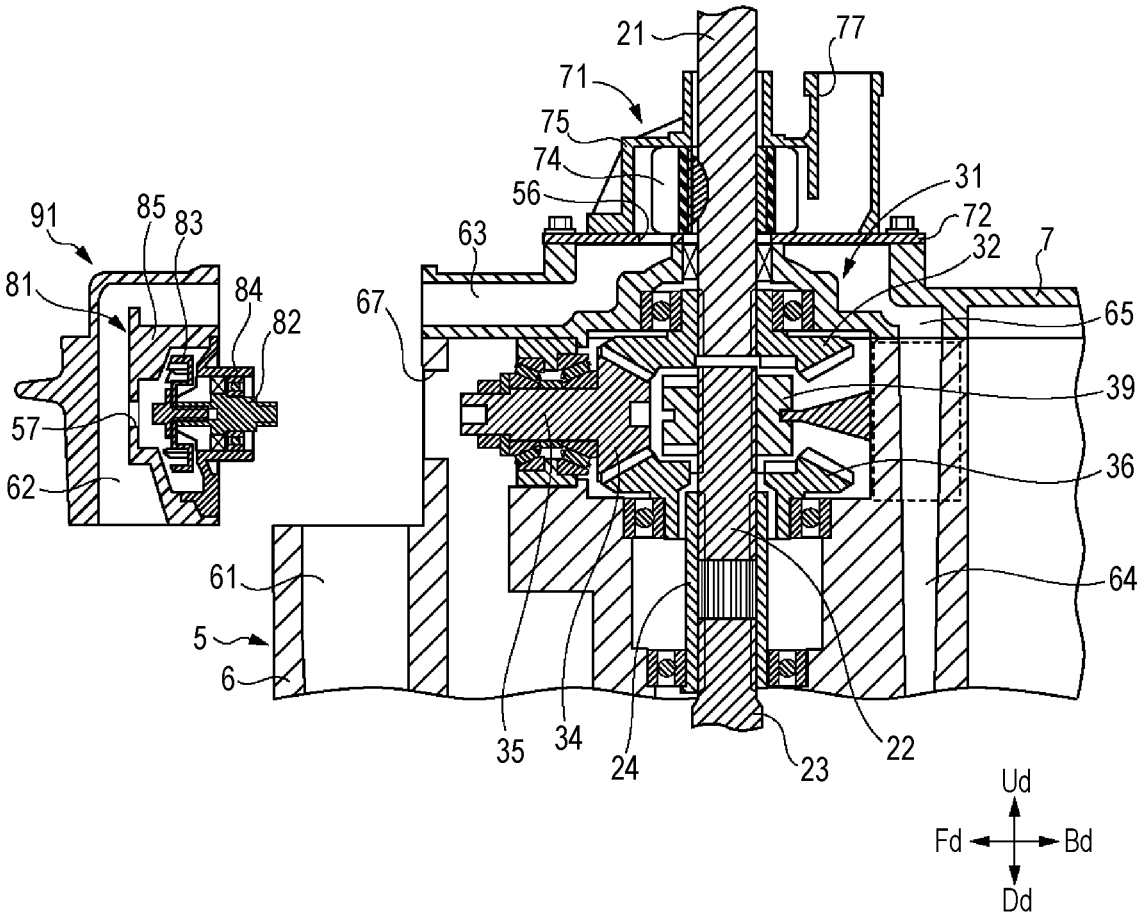
FIG. 8 is a cross-sectional view illustrating a state in which a secondary pump unit is separated from a lower case in the lower portion of the outboard motor in FIG. 5.

The secondary pump 81 and the passage portion 62 form the secondary pump unit 91. As illustrated in FIG. 8, the secondary pump unit 91 can be attached to and detached from the lower case 5. As illustrated in FIG. 3, the secondary pump unit 91 is mounted to the lower case 5 by bolts 92. In a state where the secondary pump unit 91 is mounted to the lower case 5, as illustrated in FIG. 8, a rear portion of the shaft support portion 84 is inserted into a mounting hole 67 provided in the front upper portion of the lower case body 6. When the rear portion of the shaft support portion 84 is inserted into the mounting hole 67, the rear end portion of the pump shaft 82 is spline-coupled to the front end portion of the intermediate gear shaft 35. The secondary pump unit 91 can be separated from the lower case 5 by removing the bolts 92 and moving the secondary pump unit 91 toward the front side with respect to the lower case 5.

Although not shown, the outboard motor 1 includes a first water supply passage through which the cooling water discharged from the discharge port 77 of the primary pump 71 is transferred to the engine 15 and the like, a second water supply passage through which the cooling water transferred by the connecting pipe 88 connected to the discharge port 86 of the secondary pump 81 is further transferred to the engine 15 and the like, a cooling passage for cooling the engine 15 and the like by causing the cooling water transferred to the engine 15 and the like via the first water supply passage and the second water supply passage to flow around or inside the engine 15 and the like, and a water discharge passage and a water discharge port through which the cooling water after flowing through the cooling passage is discharged from the outboard motor 1 to the outside. Each of the first water supply passage and the second water supply passage is formed of, for example, a water supply pipe, and these water supply pipes are arranged in the upper case 4, the bottom cowl 2, and the like. The cooling passage is, for example, a water jacket provided at the engine 15 and the like. The water discharge passage is formed by, for example, a water discharge pipe, and the water discharge pipe is arranged in the bottom cowl 2, the upper case 4, the lower case 5, and the like. The water discharge port is provided, for example, in a rear portion of the lower case 5.

When the engine 15 is operated and the upper shaft portion 21 and the intermediate gear shaft 35 are rotating, the impeller 74 of the primary pump 71 is rotated to drive the primary pump 71, and at the same time, the impeller 83 of the secondary pump 81 is rotated to drive the secondary pump 81. Accordingly, the water taken in from each main water intake port 52 flows upward in the common passage 54, and branches into the first dedicated passage 55 and the second water suction port 57 at the upper portion of the common passage 54. The water flowing into the first dedicated passage 55 from the upper portion of the common passage 54 flows through the first dedicated passage 55 and flows into the pump case 75 of the primary pump 71 via the first water suction port 56. The water flowing into the second water suction port 57 from the upper portion of the common passage 54 flows into the pump case 85 of the secondary pump 81. On the other hand, by driving the primary pump 71, the water taken in from each sub-water intake port 58 flows through the second dedicated passage 60 and flows into the pump case 75 of the primary pump 71 via the first water suction port 56.

The water flowing into the pump case 75 of the primary pump 71 is discharged as cooling water from the discharge port 77 of the primary pump 71. The water flowing into the pump case 85 of the secondary pump 81 is discharged as cooling water from the discharge port 86 of the secondary pump 81, and then flows through the connecting pipe 88.

The cooling water discharged from the discharge port 77 of the primary pump 71 and the cooling water discharged from the discharge port 86 of the secondary pump 81 and flowing through the connecting pipe 88 respectively flow through the first water supply passage and the second water supply passage in parallel, and then flow through the cooling passage to cool the engine 15 and the like. Thereafter, the cooling water flows through the water discharge passage and is discharged from the water discharge port to the outside of the outboard motor 1.

As described above, the outboard motor 1 according to the embodiment of the present disclosure includes the primary pump 71 and the secondary pump 81, and the primary pump 71 and the secondary pump 81 are arranged in the outboard motor 1 in a distributed manner. According to the outboard motor 1 of the present embodiment, even if each of the primary pump 71 and the secondary pump 81 is a small pump, when the two pumps 71 and 81 are simultaneously driven to supply cooling water to the cooling passage such as a water jacket, a flow rate of the cooling water flowing through the cooling passage can be increased, and the effect of cooling the engine 15 and the like can be improved. In addition, according to the method of arranging the two small pumps 71 and 81 in a distributed manner, the two pumps 71 and 81 can be provided in the outboard motor 1 by using small empty areas or the like existing in a distributed manner in the outboard motor 1, and an increase in size of the outboard motor 1 can be prevented.

Further, according to the outboard motor 1 of the present embodiment, since the two pumps 71 and 81 are provided, even when any one of the pumps does not operate normally due to a failure or the like, the cooling water can be supplied to the cooling passage by the operation of the other pump, and overheating of the engine 15 can be prevented.

In the outboard motor 1 of the present embodiment, the primary pump 71 is disposed at the outer peripheral side of the drive shaft 20 such that the impeller 74 thereof is coaxial with the drive shaft 20, and the secondary pump 81 is disposed at the position at the front side of the drive shaft 20 and spaced apart from the drive shaft 20. According to this configuration, with respect to the primary pump 71, the impeller 74 can be rotated by directly using the rotation of the drive shaft 20, and a configuration of transmitting the rotation from the drive shaft 20 to the impeller 74 can be simplified. Further, with respect to the secondary pump 81, since an empty area larger than other areas exists at the front side of the drive shaft 20 in the outboard motor 1, an area in which the secondary pump 81 is to be installed can be relatively easily secured at the front side of the drive shaft 20. Therefore, the secondary pump 81 can be provided in the outboard motor 1 and an increase in size of the outboard motor 1 can be avoided.

In the outboard motor 1 according to the present embodiment, the secondary pump 81 is disposed at the front portion of the lower case 5, at a position that is located below the water surface when the boat is stopped and that is higher than the anti-cavitation plate 13. According to this configuration, the position of the secondary pump 81 is a position lower than the water surface when the boat is stopped or sailing at a low speed, and is a position slightly higher than the water surface (a position higher than the water surface but close to the water surface) when the boat is planing. Accordingly, it is possible to prevent an occurrence that the secondary pump 81 sucks in air, the air is mixed into the cooling water to be discharged from the secondary pump 81, and as a result, a discharge amount of the cooling water decreases. That is, when the boat is stopped or sailing at a low speed, the position of the secondary pump 81 is lower than the water surface, and a position of a water suction path of the secondary pump 81 (the passage from the main water intake port 52 to the second water suction port 57) is also lower than the water surface. Therefore, even in a case where the impeller 83 of the secondary pump 81 is stopped when the boat is stopped, or even in a case where a rotation speed of the impeller 83 of the secondary pump 81 is low when the boat is sailing at a low speed, the water suction path of the secondary pump 81 is filled with water, and thus it is possible to prevent the secondary pump 81 from sucking air. On the other hand, during planing of the boat, the position of the secondary pump 81 is slightly higher than the water surface. But at this time, a rotation speed of the drive shaft 20 is high, and accordingly, a rotation speed of the intermediate gear shaft 35 is also high. Therefore, the rotation speed of the impeller 83 of the secondary pump 81 is also high, and as a result, a suction force generated by the impeller 83 is large. Therefore, since the water suction path of the secondary pump 81 is filled with water due to the suction force generated by the impeller 83, it is possible to prevent the secondary pump 81 from sucking air.

Since the position of the secondary pump 81 is higher than the water surface when the boat is planing, it is possible to prevent an increase in resistance of water when the boat is planing. That is, even if a dimension of a portion in the left-right direction above the anti-cavitation plate 13 in the lower case 5 is increased due to the installation of the secondary pump 81, since the portion comes out above the water surface when the boat is planing, an increase in resistance of water can be prevented.

In the outboard motor 1 according to the present embodiment, the primary pump 71 is mounted on the upper surface of the lower case 5. Accordingly, the primary pump 71 can be easily removed from the lower case 5, and maintenance such as replacement of the impeller 74 can be easily performed.

In the outboard motor 1 according to the present embodiment, the water intake passage 51 includes: the main water intake ports 52 that are provided in the lower portion of the front portion of the lower case 5; the common passage 54 that is connected to the main water intake ports 52 and extends to the upper side in the front portion of the lower case 5; the first dedicated passage 55 and the first water suction port 56 that connect the upper portion of the common passage 54 and the inside of the pump case 75 of the primary pump 71; and the second water suction port 57 that connects the upper portion of the common passage 54 and the inside of the pump case 85 of the secondary pump 81. With this configuration, the water suction paths respectively connected to the primary pump 71 disposed on the upper surface of the lower case 5 and the secondary pump 81 disposed at the front upper portion of the lower case 5 can have a part common to each other, and the common water suction path can be shortened. Therefore, water suction of each of the pumps 71 and 81 can be made smooth, and a structure of the water suction path can be simplified.

In the outboard motor 1 according to the present embodiment, the secondary pump 81 is driven by the rotation of the intermediate gear shaft 35 in the rotation direction switching mechanism 31. With this configuration, a member for transmitting the rotational output of the engine 15 to the impeller 83 of the secondary pump 81 disposed at a position spaced apart from the axis A of the drive shaft 20 can be implemented by using a part of the rotation direction switching mechanism 31. Therefore, since it is not necessary to separately provide a member for transmitting the rotational output of the engine 15 to the impeller 83 of the secondary pump 81 disposed at a position spaced apart from the axis A of the drive shaft 20, it is possible to prevent complication of the structure of the outboard motor 1, and it is possible to reduce the number of components of the outboard motor 1. Further, in the rotation direction switching mechanism 31, a diameter of the reverse intermediate gear 34 is smaller than a diameter of the reverse drive gear 32, and thus the intermediate gear shaft 35 has a higher rotation speed than the drive shaft 20. Therefore, the rotation speed of the impeller 83 of the secondary pump 81 can be easily increased, and the discharge amount of the cooling water by the secondary pump 81 can be increased. Therefore, even when the rotation speed of the drive shaft 20 is low, supply of the cooling water to the cooling passage by the secondary pump 81 can be stabilized.

In the rotation direction switching mechanism 31 of the outboard motor 1 of the present embodiment, the reverse intermediate gear 34 and the intermediate gear shaft 35 are disposed at the front side of the drive shaft 20, and the shift fork 42 and the clutch control portion 43 are disposed at the rear side of the drive shaft 20. The secondary pump 81 is disposed at the front side of the drive shaft 20, and a rear end of the pump shaft 82 of the secondary pump 81 is coupled to a front end of the intermediate gear shaft 35. With this configuration, the arrangement of the secondary pump 81 to the front upper portion of the lower case 5 and the transmission of the rotational output of the engine 15 to the secondary pump 81 can be easily implemented while preventing an increase in size of the outboard motor 1.

In the outboard motor 1 according to the present embodiment, since the secondary pump 81 is disposed at the front upper portion of the lower case 5, the secondary pump 81 (secondary pump unit 91) can be easily attached to and detached from the lower case 5. Accordingly, it is possible to easily perform maintenance of the secondary pump 81, such as replacement of the impeller 83.

In the above embodiment, the two main water intake ports 52 and the common passage 54 form a common water suction path for the primary pump 71 and the secondary pump 81. However, the water suction path of the primary pump 71 and the water suction path of the secondary pump 81 may be completely independent of each other. For example, a passage L connecting the left main water intake port 52 and the first water suction port 56 and a passage R connecting the right main water intake port 52 and the second water suction port 57 may be separately provided. Accordingly, even when one of the two left and right main water intake ports 52 is clogged and blocked, water can be taken in from the other main water intake port 52 to cool the engine 15 and the like.

In addition, a communication passage that connects a middle part of the passage L connecting the left main water intake port 52 and the first water suction port 56 and a middle part of the passage R connecting the right main water intake port 52 and the second water suction port 57, and a valve that opens and closes the communication passage may be provided. When both of the two pumps 71 and 81 are operating normally, the valve may be closed to supply water to the two pumps via the passage L and the passage R respectively, and when one of the two pumps 71 and 81 is not operating normally, the valve may be opened to supply water to the other pump via the passage R, the passage L, and the communication passage. Accordingly, when one of the two pumps 71 and 81 does not operate normally, it is possible to prevent the effect of cooling the engine 15 and the like from decreasing significantly.

Although the primary pump 71 is disposed on the upper surface of the lower case 5 in the above embodiment, the primary pump 71 may be disposed at another position (for example, a lower position) at the outer peripheral side of the drive shaft 20.

In the above embodiment, the reverse intermediate gear 34 and the intermediate gear shaft 35 are disposed at the front side of the drive shaft 20, the shift fork 42 and the clutch control portion 43 are disposed at the rear side of the drive shaft 20, the secondary pump 81 is disposed at the front side of the drive shaft 20, and the pump shaft 82 of the secondary pump 81 and the intermediate gear shaft 35 are coupled to each other. Alternatively, when an installation position of the secondary pump 81 can be secured at the rear side of drive shaft 20, the reverse intermediate gear 34 and the intermediate gear shaft 35 may be disposed at the rear side of the drive shaft 20, the shift fork 42 and the clutch control portion 43 may be disposed at the front side of the drive shaft 20, the secondary pump 81 may be disposed at the rear side of the drive shaft 20, and the pump shaft 82 of the secondary pump 81 and the intermediate gear shaft 35 may be coupled to each other.

Although a case, in which a positive displacement pump is employed as the primary pump 71 and a non-positive displacement pump is employed as the secondary pump 81, is described as an example in the above embodiment, a system or type of the pump is not limited for both of the primary pump 71 and the secondary pump 81.

Although a pump that directly transmits rotation of the drive shaft 20 to rotate an impeller thereof is set as the primary pump and a pump that transmits rotation of an intermediate shaft to rotate an impeller thereof is set as the secondary pump in the above embodiment, division of roles of a primary (main) pump and a secondary (sub) pump for two pumps can be modified appropriately, and the two pumps may be allotted the same role.

A cooling target of the cooling water discharged from the primary pump 71 and a cooling target of the cooling water discharged from the secondary pump 81 are not limited. For example, the engine 15 may be cooled by the cooling water discharged from the primary pump 71 and the cooling water discharged from the secondary pump 81, or the engine 15 may be cooled by the cooling water discharged from the primary pump 71 and an oil cooler may be cooled by the cooling water discharged from the secondary pump 81.

The present disclosure can be modified as appropriate without departing from the gist or idea of the disclosure which can be read from the claims and the entire specification, and the outboard motor to which this modification is applied is also included in the technical idea of the present disclosure.

What is claimed is:

1. An outboard motor for propelling a boat, the outboard motor comprising:

a power source provided at an upper portion of the outboard motor;

a drive shaft extending in an up-down direction from the power source toward a lower portion of the outboard motor and configured to be rotated by a rotational output of the power source;

a propeller shaft provided at the lower portion of the outboard motor and configured to be rotated by rotation of the drive shaft;

a propeller attached to the propeller shaft;

a case covering the power source, the drive shaft, and the propeller shaft;

a water intake passage provided in the case, through which water is taken into the case from an outside of the outboard motor;

a first pump configured to be driven by rotation of the drive shaft and to supply the water taken in from the water intake passage to the power source as cooling water; and a second pump configured to be driven by rotation of the drive shaft and to supply the water taken in from the water intake passage to the power source as the cooling water, wherein the first pump and the second pump are arranged in a distributed manner in the outboard motor.

2. The outboard motor according to claim 1, wherein the first pump is disposed at an outer peripheral side of the drive shaft such that an impeller of the first pump is disposed coaxially with the drive shaft, and wherein the second pump is disposed at a front side of the drive shaft and apart from the drive shaft.

3. The outboard motor according to claim 2, wherein the case includes a cowl covering the power source, an upper case covering an upper portion of the drive shaft, and a lower case covering a lower portion of the drive shaft and a front portion of the propeller shaft, wherein the lower case is provided with an anti-cavitation plate, and wherein the second pump is disposed at a front portion of the lower case and a position that is located below a water surface when the boat is stopped and that is higher than the anti-cavitation plate.

4. The outboard motor according to claim 3, wherein the first pump is mounted on an upper surface of the lower case.

5. The outboard motor according to claim 4, wherein the water intake passage includes a water intake port provided in a lower portion of the front portion of the lower case, a main passage connected to the water intake port and extending to an upper side in the front portion of the lower case, and two branch passages branched from an upper portion of the main passage and connected to the first pump and the second pump respectively.

6. The outboard motor according to claim 1, wherein the drive shaft is divided into a first shaft portion, whose upper end side is connected to the power source, formed in an upper portion of the drive shaft and configured to be rotated in one direction by a rotational output of the power source, and a second shaft portion, whose lower end side is connected to the propeller shaft, formed in a lower portion of the drive shaft, wherein a rotation direction switching mechanism configured to switch a rotation direction of the propeller shaft is provided between the first shaft portion and the second shaft portion, the rotation direction switching mechanism including a reverse drive gear that is a bevel gear fixed to a lower end side of the first shaft portion and configured to rotate in the one direction, a reverse intermediate gear that is a bevel gear configured to be meshed with the reverse drive gear, an intermediate gear shaft that has an axis perpendicular to an axis of the drive shaft and to which the reverse intermediate gear is fixed, a reverse output gear that is a bevel gear disposed coaxially with the reverse drive gear and configured to be meshed with the reverse intermediate gear and is configured to rotate in a reverse direction with respect to the one direction, and a clutch configured to select whether to transmit rotation of the first shaft portion or the reverse drive gear in the one direction to the second shaft portion or to transmit rotation of the reverse output gear in the reverse direction to the second shaft portion, and wherein the second pump is configured to be driven by rotation of the intermediate gear shaft.

* * * * *